United States Patent [19]

Van Erden et al.

[11] Patent Number: 5,063,069

[45] Date of Patent: Nov. 5, 1991

[54] ZIPPERED CLOSURE FOR THERMOFORMED PACKAGE

[75] Inventors: Donald L. Van Erden, Wildwood; Daniel P. McDonald, Arlington Heights, both of Ill.; Steven Ausnit, New York, N.Y.

[73] Assignee: Zip-Pak Incorporated, Northbrook, Ill.

[21] Appl. No.: 515,628

[22] Filed: Apr. 27, 1990

Related U.S. Application Data

[63] Continuation-in-part of Ser. No. 327,619, Mar. 23, 1989.

[51] Int. Cl.[5] ..... B65D 33/16

[52] U.S. Cl. ..... 426/122; 383/61; 383/63; 383/93; 383/95; 383/203; 426/121; 426/123

[58] Field of Search ..... 383/61, 62, 63, 65, 383/93, 94, 95; 206/620, 630, 604, 606, 608, 610; 426/121, 122, 123, 129

[56] References Cited

U.S. PATENT DOCUMENTS

| | | | |
|---|---|---|---|
| 2,017,838 | 10/1935 | Baker et al. | 229/55 |
| 2,340,546 | 2/1944 | Meaker | 229/55 |
| 2,546,698 | 3/1951 | Nicolle | 206/620 |
| 2,978,769 | 4/1961 | Harrah | 24/201 |
| 3,181,583 | 5/1965 | Lingenfelter | 383/94 |
| 3,300,120 | 1/1967 | McColgan | 229/55 |
| 3,473,589 | 10/1969 | Götz | 206/620 |
| 3,746,215 | 7/1973 | Ausnit et al. | 222/92 |
| 3,780,781 | 12/1973 | Uramoto | 206/620 |
| 3,827,472 | 8/1974 | Uramoto | 383/63 |
| 3,991,801 | 11/1976 | Ausnit | 383/61 |
| 4,003,184 | 1/1977 | Shiv | 426/121 |
| 4,191,230 | 11/1980 | Ausnit | 150/3 |
| 4,196,030 | 4/1980 | Ausnit | 156/91 |
| 4,235,653 | 11/1980 | Ausnit | 156/91 |
| 4,249,982 | 2/1981 | Ausnit | 156/461 |
| 4,285,376 | 8/1981 | Ausnit | 150/3 |
| 4,657,792 | 4/1987 | Ausnit | 428/35 |

FOREIGN PATENT DOCUMENTS

| | | | |
|---|---|---|---|
| 2914206 | 10/1980 | Fed. Rep. of Germany | 206/630 |

*Primary Examiner*—Donald E. Czaja
*Assistant Examiner*—Drew S. Workman
*Attorney, Agent, or Firm*—Hill, Van Santen, Steadman & Simpson

[57] ABSTRACT

A plastic film bag for foodstuffs or the like having opposed film bag walls joined at their edges and forming a mouth between the walls and at one side reclosable fastener strips between the walls at the bag mouth having facing releasably interlocking profiles thereon with a sealing strip extending from one profile to the wall of the other profile with the sealing strip being sufficiently broad to avoid stress thereon and preferably with the sealing strip having a frangible fracture line extending substantially parallel to the profile to be torn when the profiles are first separated with the fracture line formed in various ways including perforations, or a score line, or an insert in the sealing web defining the frangible fracture line or the web being formed of multiple parts joined by a portion that fracture more easy than the sealing web.

17 Claims, 3 Drawing Sheets

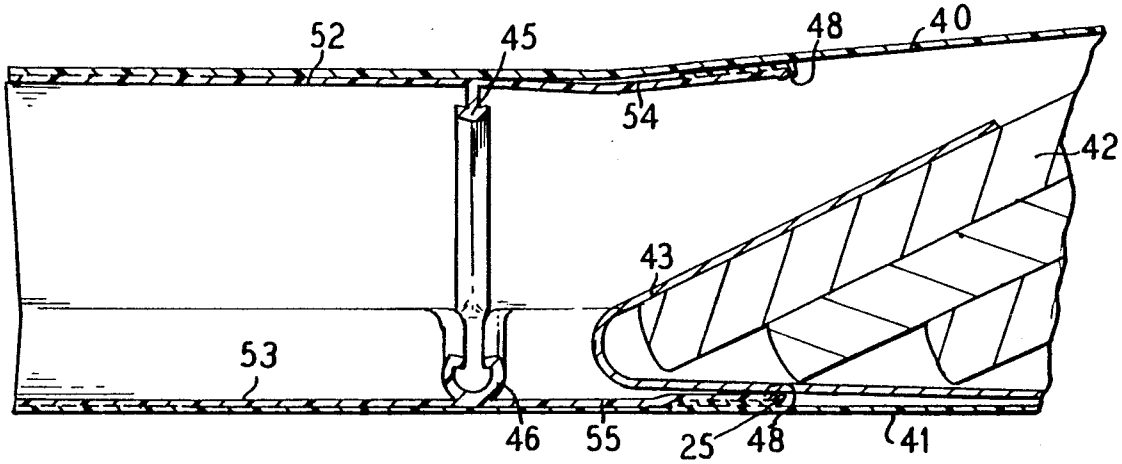
FIG. 8
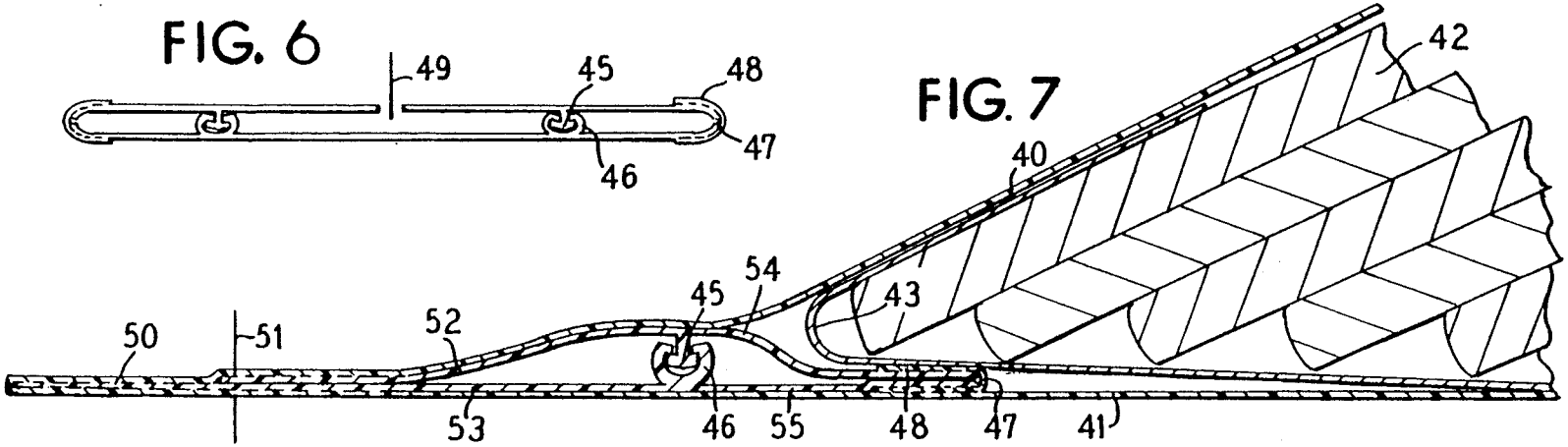
FIG. 7
FIG. 6
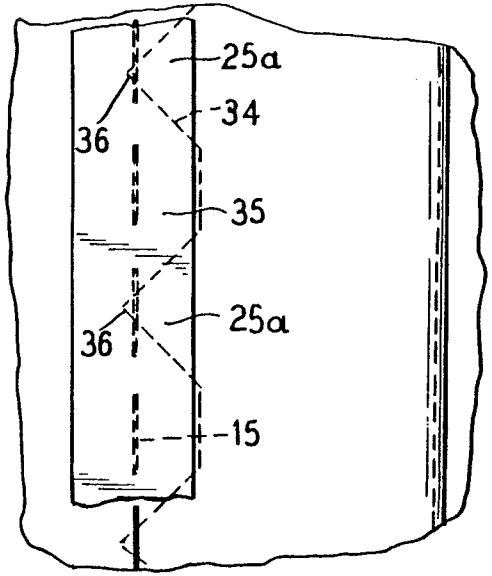
FIG. 9

ZIPPERED CLOSURE FOR THERMOFORMED PACKAGE

RELATED APPLICATION

This application is a continuation-in-part of U.S. Ser. No. 327,619, Filed Mar. 23, 1989, Entitled "Zippered Closure for Thermoformed Package", Inventors: Donald L. Van Erden and Daniel P. McDonald.

BACKGROUND OF THE INVENTION

This invention relates to improvements in the packaging art, and more particularly to improvements in reclosable bags.

In the provision of reclosable bags, and particularly those which are used for foodstuffs, it is desirable that a structure be used by which the bag is initially fully sealed. When used for general merchandise, this prevents tampering with the contents, and when used for foodstuffs, the initial sealing protects the contents from spoilage and tampering or contamination due to intentional access to the bag or due to the entrance of air or contaminants. It is further desirable that the initial sealing be such that it is not inadvertently opened due to handling of the bag, and if opened, that there is a tamper-evident feature which would show the purchaser that the bag had been previously opened. These objectives must be accomplished without adversely affecting the reclosable feature that is used.

In some arrangements previously used, a sealing means has been provided outside of the reclosable fastener, but these allow an air space between the reclosable structure and the contents. Also, if the bag holds food items, the presence of the food especially in powdered form can contaminate or interfere with the reclosable structure. This is particularly true where a fine rib and groove profile type of closure is used which should be kept clear of contaminants which would interfere with the interlocking of the closing structure.

It is accordingly an object of the present invention to provide an improved flexible plastic bag structure which has a reclosable zipper at the mouth and which is provided with a unique sealing arrangement to prevent contamination of the foodstuffs within the container and prevent the foodstuffs from contacting the reclosable zipper.

A further object of the invention is to provide an improved fastener with a tamper evident feature.

A further object of the invention is to provide an improved fastener which is doubly and/or triply sealed with sealing means outwardly of the reclosable fastener and sealing means inside of the fastener within the bag.

A still further object of the invention is to provide an improved bag and fastener structure which is particularly well suited for containing foodstuffs such as sliced meat, cheeses and other items which must be completely isolated from the outside before using.

A further object of the invention is to provide an improved reclosable fastener for a bag mouth with a sealing membrane inside of the fastener of a length and structure so that the membrane is not stressed during handling of the bag prior to separating the reclosable fastener.

FEATURES OF THE INVENTION

The invention utilizes a plastic barrier type film bag for containing foodstuffs such as stacked slices of bacon or meat. The plastic film bag is sealed around three edges and has a mouth along the fourth side edge. In the bag mouth is a reclosable zipper. The zipper is formed from opposed fastener strips each having a base web with a complementary rib and groove type of interlocking profile on said webs. The strips' base webs are provided with portions extending inwardly toward the foodstuffs within the bag and portions extending outwardly. The portion of one base web which extends inwardly is arranged to be bonded to the opposite film wall of the bag to form a barrier membrane of a barrier web. This barrier membrane thereby is located between the zipper profiles and the bag contents preventing foodstuffs or other bag contents from coming into contact with the zipper profile prior to use. A frangible line may be placed in the barrier membrane. This may be provided by perforations which permit tearing of the membrane as the package is initially being opened.

The barrier membrane affords a multitude of other functional advantages and possibilities which are extremely advantageous in a reopenable flexible bag particularly where the bag is used to contain foodstuffs. For example, the barrier may be designed to be of a different material than that of the bag or even of the zipper profiles, and this will create the ability to choose a material to selectively bleed gas from inside of the bag. Also, an important function of the barrier membrane is that it provides a tamper-evident seal. When the consumer first uses the bag, he fractures the barrier membrane to have access to the contents. Prior to that time, if the zipper is opened and the barrier membrane is intact and not torn, the user will positively know that there has been no access to the foodstuffs inside of the bag. This affords a reopenable bag, yet one which is positively sealed up to the time when the consumer desires to use the bag and have access to the contents. Other objectives and functions can be attained by varying the material used for the barrier membrane, for example, the barrier membrane may be of a different color than the bag material at the mouth of the bag so that when the zipper is opened, the barrier membrane will be more visible and it will be more easy to detect that the barrier membrane has not been broken and the lack of tampering will be quite evident. By providing the barrier membrane as extending from one of the profiles to the opposite wall of the bag and being attached at a height lower than the profiles, the barrier membrane becomes more visible when the profiles are separated and provides greater strength for the unopened bag. Also, by providing a frangible tear line in the barrier membrane close to the opposed wall of the bag, a flap will remain when the barrier membrane is broken which flap provides a handy feature for withdrawing the contents from the bag or for reinserting the contents. While a frangible tear line in the barrier membrane is desirable, it is not essential that such be provided and the barrier membrane can be separated by cutting when the bag is first opened.

The barrier membrane may be made of a material which is grain oriented so that a strong pull in the opening direction after separating the profiles will readily tear the barrier membrane. Also, the membrane may be made of lighter weight material than the bag walls or of the pull flanges at the mouth of the bag so that it is more easily torn. The barrier membrane may also be made of a plastic which has a lower melt point than the bag walls so that heat can be applied for attaching the edge of the membrane to the wall without melting the plastic of the walls or injuring or deforming the plastic profiles of the zipper. The physical characteristics of the barrier membrane can be chosen different than the bag walls and/or different than the zipper profiles to attain different functions for the membrane. While the membrane is preferably formed as part of the base of the profile at one wall and attached to the other wall, a separate membrane may be used secured to the one wall at the base of the profile and to the other wall below the profile.

The base webs of the profiles which extend outwardly of the bag mouth may be attached or laminated to the bag walls to provide pull flanges for separating the profiles and opening the bag. The film of the bag walls may extend beyond the edge of the base web portions and be joined to each other to seal the bag outwardly of the zipper profiles.

More generally, the objectives of the invention are served by providing a flexible rib and groove fastener at the mouth of the bag with a sealing web barrier membrane inside of the rib and groove fastener. The sealing membrane extends from one wall of the bag adjacent the profile fastener to the other wall at an attachment location which is below the profile fastener with the membrane being of a length so that it is not stressed during normal handling of the bag. However, when the zipper fastener is separated, the membrane then is torn to remove the contents of the bag and the bag is then reclosable by joining the profile fastener.

Other objects, advantages and features will become more apparent with the teaching of the principles of the invention in connection with the disclosure of the preferred embodiments thereof in the specification, claims and drawings, in which:

DESCRIPTION OF THE DRAWINGS

FIG. 6 is an end elevational view similar to FIG. 2 illustrating a modified form of the fastener strips which are used;

FIG. 7 is a vertical sectional view taken through a container top using a fastener of FIG. 6;

FIG. 8 is another view of FIG. 7 showing the position of the parts as the bag is opened;

FIG. 9 is a sectional view taken substantially along line IX—IX of FIG. 4; and

DESCRIPTION OF THE PREFERRED EMBODIMENT

Figures 1, 2, 3, 4, 5:
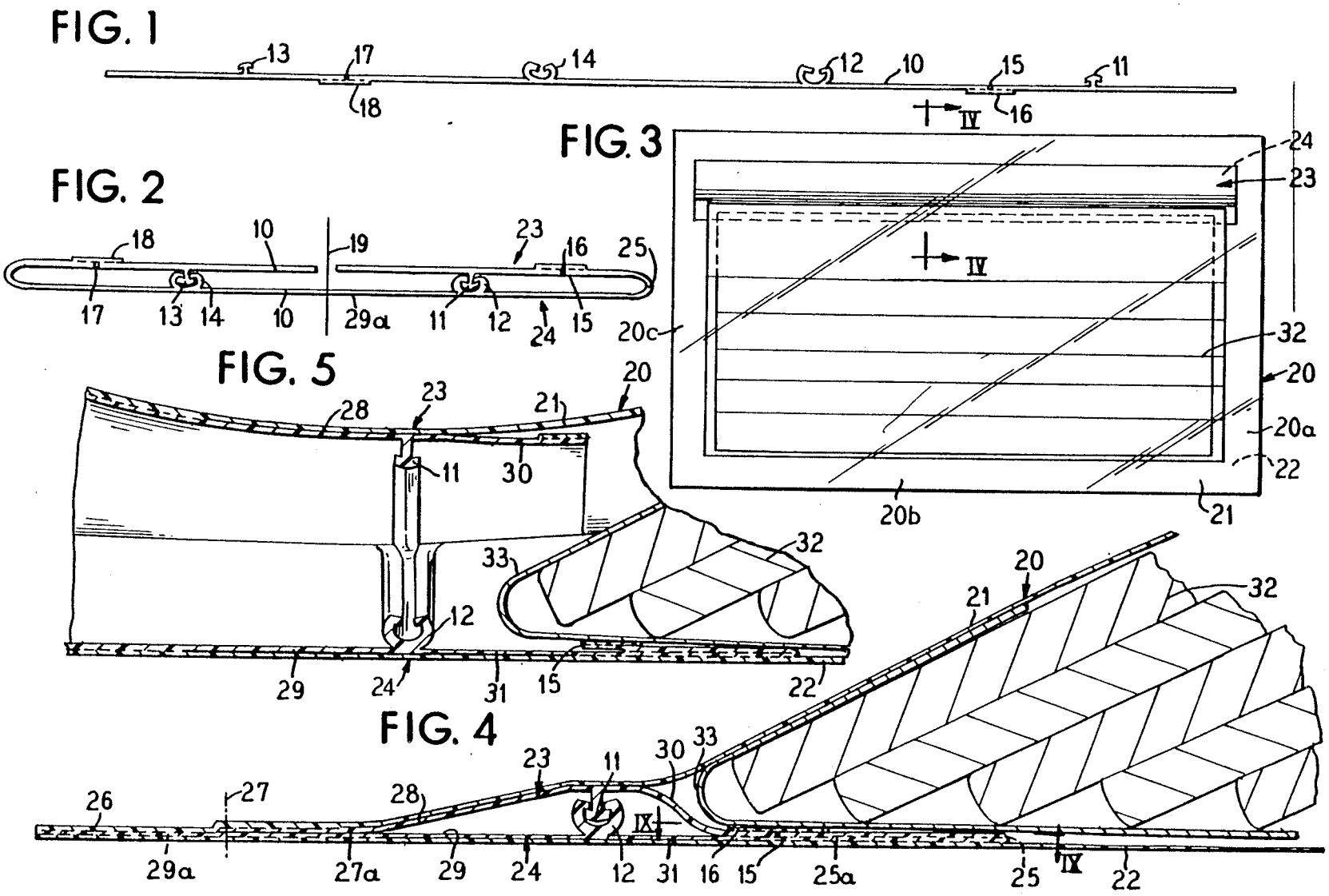
FIG. 1 is an end elevational view of a pair of connected fastener strips to be used for bag closures.
FIG. 2 illustrates the strip of FIG. 1 folded to join the interlocking profiles.
FIG. 3 is a plan view of a flexible film package with a fastener strip of FIG. 2 installed.
FIG. 4 is a sectional view taken substantially along line IV—IV.
FIG. 5 is a sectional view similar to FIG. 4 illustrating the position of the parts as the bag is being opened for the first time.

As illustrated in FIGS. 1 and 2, a dual fastener strip each consisting of strips 23 and 24 is provided. These strips are usually formed by a single extrusion process either in a tube or a flat form with the strips having a backing base web 10 with shaped interlocking profiles on the surface of the backing web. Male rib profile 11 of strip 23 is shaped and sized to interlockingly fit into female groove profile 12 of strip 24 and a rib profile 13 of the second strip 23 is shaped and sized to fit into a groove profile 14 of the second strip 24. Additionally, frangible tear lines formed by perforations at 15 and 17 extend along the web 10 parallel to the profiles. So that leakage through the perforation lines is prevented, a protective sealing strip is adhered over the perforations as shown by the strips 16 and 18. The web 10, as shown in FIG. 1, is folded bringing the profiles into interlocking relationship as shown in FIG. 2. The dual strip is then cut at 19. Portions 29*a* and 27*a* will eventually form part of the pull flanges for opening the bag. Preferably the web portion 29*a* is slightly longer than the web portion 27*a* as will become more clear in connection with the description of FIG. 4.

FIG. 3 illustrates a fastener strip of FIGS. 1 and 2 assembled in a package 20. The package forms a bag having a film wall 21 at one side and an opposing film wall 22 at the other side. These film walls are sealed to each other along their edges 20*a*, 20*b* and 20*c*. An opening mouth is located at the bag top and the fastener strip 23 is located at the top between the layers of film.

While FIG. 3 illustrates the fastener strip not extending to the complete sides of the film walls 21 and 22, it will be understood that in some constructions, it will be desirable that the fastener strip extend fully to the edges of the film, and the features of the invention are not to be limited by the illustration of FIG. 3.

As illustrated in FIG. 4, the bag contents, such as layers of bacon 32, are positioned between the film walls 21 and 22 and a stiffening folded cardboard insert 33 extends along one side of the layers of bacon providing a stiffness to the bag. The cardboard 33 will be unique to the type of foodstuffs within the bag and is useful in the case of a greasy material such as bacon to help prevent migration of the grease. However, it will be seen that the arrangement and structure of the fastener is such that the interlocking profiles 11 and 12 are protected by the location of a membrane 30.

The thin film plastic walls extend to the top edge of the bag and are heat sealed to each other at 26. As illustrated, an upper portion 29*a* of the base web may extend between the layers of film and be joined thereto, sandwiched by the heat seal lamination at 26. Alternately, the top portion 27*a* of the base web can be made longer and also be sealed between said film layers. The top edge lamination 26 may also be provided with hang holes for rack hanging the finished package.

The fastener strips 23 and 24 can be, for the purpose of reference, described as upper and lower strips, but their relative location is either at the top wall or lower wall and the location is not material to their function. The upper strip 23 has a base web with an outer portion 28, FIG. 4, which extends outwardly away from the bag contents toward the bag top. The lower strip 24 has an outer portion 29 of the base web which extends outwardly away from the contents or also toward the bag top. The upper strip 23 has an inner web portion 30 extending inwardly toward the bag contents. The lower strip 24 has an inner base web portion 31 which extends inwardly in the bag toward the contents. The inner base web portions 30 and 31 are integral with each other forming a fold at 25 and are initially manufactured by extrusion in the form shown in FIG. 2.

The strips 23 and 24 in their location in the mouth of the bag are laminated to the inner surfaces of the bag film walls 21 and 22. In its preferred from, the lower strip 24 is laminated over its full length so that the outer base web portion 29 and the inner base web portion 31 are both laminated over their full surface.

In its preferred form, FIG. 4, the upper strip 23, however, is laminated over the outer base web portion 28, which lamination extends to a location just below the rib 11. The inner base web portion 30, however, is free of lamination to the film 21 and extends downwardly beneath the bacon layers 32 to lay along the inner bag wall 31. At their lower folded edge 25, the webs are laminated to each other over the area 25*a* extending from the fold 25 to the perforations 15. The web base 30, forms a barrier membrane extending free of lamination from the profile 11 to the other bag wall 22 at a location spaced downwardly from the profiles. Thus, by virtue of the barrier membrane 30 having its upper edge adjacent the profiles and its lower edge at a lower location, it remains more stress free when the bag is being handled or stored. While the barrier membrane is preferably integral with the upper fastener strip, in some instances, it may be desired to provide a barrier membrane such as 30 which is attached to the profile or to the upper wall just adjacent the profile along one edge and attached to the lower wall at a location spaced downwardly from the downwardly from the profiles. The barrier web thus extends at an angle to the walls. In other words, the web does not have both ends attached at the profiles as has been the structural arrangement with barrier webs of the type heretofore used, but one edge of the barrier membrane is attached to one wall adjacent the profiles and at the other edge to the opposite wall at a location spaced downwardly from the profiles so that the barrier in essence extends diagonally relative to the bag walls and the profiles.

In a preferred form, the cap material 16 and 18 in FIG. 2 which seals the perforations, has a lower melt temperature than the base web 10. This will permit the cap material to be heat sealed to the web by applying a heat sealing material yet preventing the layers of the base web 10 from being sealed to each other.

The use of the perforations with the overlying sealing cap arrangement permits using a cap of different material and the cap can be designed to have limited porosity to bleed gas through the perforations.

The bag contents are fully sealed from contaminants in the store until the purchaser buys the bag 20 and first opens it. A triple seal prevents the passage of air from the atmosphere to the bag contents 32. First, the laminated film at 26 provides a barrier. Next, the joined rib and groove 11 and 12 provide a barrier. Further, the base strip portions 30 and 31 are connected to each other at 25 to provide a barrier and the perforations are sealed by the cap strip 16.

While the barrier web or membrane 30, FIG. 4 is preferably provided with a frangible fracture line, in some instances, the membrane itself will be of light enough structure so that it can be torn. Various arrangements can be employed to allow membrane separation as shown in FIGS. 10–20. The membrane provides an important function as a moisture barrier to prevent liquids and particles packaged within the bag from passing into the zipper area. As will be seen, the membrane 30 is sufficiently long so that it is not stressed during normal handling of the package. The membrane extends from the base of the profile at one wall to the other wall spaced from the profile and is of sufficient width so that at its location to where it is attached to the opposite wall, it is sufficiently wide so as not to be stressed. In other words, the width of the membrane between its attachment edges is greater than the width of the lower bag wall material from the profiles to the location of attachment of the membrane to the lower wall.

While the membrane provides a moisture barrier, it can be chosen to be of select material and can be a gas previous layer to bleed a limited amount of gas from foodstuffs in the package.

In use, after the purchaser buys the package, the package is opened by cutting off the top along a cut line 27. This permits the separation of the outer portions 28 and 29 of the base strips, which are not bonded to each other with the area 27*a*. After the top is cut off along 27, the outer portions 28 and 29 provide pull flanges as shown in FIG. 5. Pulling the pull flanges apart, separates the rib and grooves profiles 11 and 12 as shown in FIG. 5. Continued pulling of the pull flanges tears the perforation line 15 so that the remaining portion of the inner base strip 30 lifts upwardly as illustrated in FIG. 5.

To tear the perforation line 15 often requires substantial pull on the flanges, and tearing can be aided by the user inserting his fingers into the space between the strip portions 30 and 31. This still may cause difficulty in tearing the tear line, and for this purpose, areas of stress concentration are provided along the tear line 15. One manner of providing the area of stress concentration is shown in FIG. 4 and in detail in FIG. 9 wherein the bond 25*a* is terminated in an undulating line 34 along the tear line. This leaves the areas 35 free to separate and provides points 36 of stress concentration. When the user inserts his finger between the layers 30 and 31, the tear line 15 will tend to start separating at the points 36 of stress concentration. This arrangement which aids in separating the tear line 15 has been found to be particularly useful where the tear line is located in the surface of the inner web portion 30.

FIGS. 6 through 8 are provided to show another manner of construction wherein the tear line is provided at the exact location of the fold 47.

As shown in FIG. 6, a double fastener strip is provided having on one side a rib profile 45 and on the other side a groove profile 46. A tear line is provided in the strip at fold line 47 covered by a cap sealing layer 48. Before using the fastener strip on bags, the double closure strip is severed along a cut line 49 to provide two identical strips.

One sealing strip, thus severed, is shown attached in the mouth of a bag in FIGS. 7 and 8. The bag is formed having film walls 40 and 41. The fastener strips have outer base web portions 52 and 53 which extend from the profiles toward the top of the bag. Inner base web portions 54 and 55 extend from the profiles toward the bag contents The bag contents are shown as layers of meat or bacon 42 with a folded cardboard over one edge adjacent the closure strips.

The bag wall layers are bonded to each other at 50 along the top of the bag. The longer outer base web 53 may extend between the layers and be bonded therebetween.

The base webs of the fastener strips are laminated to the bag layers with the lower strip bonded to the bag wall over its full width.

The upper strip, however, is bonded over only the outer base web portion outwardly of the rib 45. The base web portion 54 is not bonded to the film and extends diagonally down beneath the top edge of the contents. The base webs are folded double at the location of the tear line 47.

In use, the purchaser finds a package fully sealed by the outer seal 50 between the film layers. An intermediate seal is provided by the interlocked rib and groove 45 and 46, and an inner seal is provided by the continuous inner strip portions 54 and 55 with the perforations protected by the sealing layer 48.

In use, the purchaser cuts off the top along a cut line 51 so that the outer strip portions 52 and 53 separate and form pull flanges. Pulling these flanges apart in the manner shown in FIG. 8, separates the rib 45 from the groove 46, and continued pull causes the barrier membrane 54 to tear away along the tear line 47. This permits removal of the bacon 42 from within the package. The membrane 54 conveniently lays along the film 40 out of the way of the contents as they are put back in the package. The membrane 54 will flip back over the upper profile 45 to protect it from contamination by food particles when the contents are pulled out of the bag. The bag is, of course, reusable and the contents can be reinserted and the rib and groove profile 45 and 46 rejoined to seal the bag.

Figure 10:
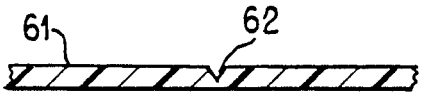
FIGS. 10 through 20 are sectional views or views partially in section with the section taken through the sealing membrane illustrating modified forms of construction within the scope of the invention.

In the structure of FIGS. 4 and 5, as illustrated in FIG. 9, the barrier membrane was separated by providing unique stress points. In the structure of FIGS. 6 through 8, the barrier membrane was separated by simple lines of perforation. In some instances, it may be desirable merely to provide a membrane with no specific tear areas so that it can be cut or torn when the bag is first opened. Other specific arrangements are contemplated for providing a barrier membrane structure which separates easily along the bottom wall of the bag. Each of these structures provide for stress separation but accomplish a moisture barrier keeping the contents from the bag from contacting the closed zipper profiles. In FIG. 10 a barrier membrane 61 is shown provided with a score line 62 which defines the line of separation where the membrane 61 will tear as it is pulled upwardly by applying forces to the pull flanges.

Figure 11:
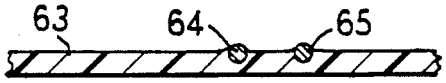

FIG. 11 illustrates a barrier membrane 63 where reinforcement threads are included in the membrane and such threads may be included by being adhered to membrane or may be formed at the time of the initial extrusion of the plastic membrane material. The membrane then will tear between the lines of reinforcement 64 and 65.

Figure 12:
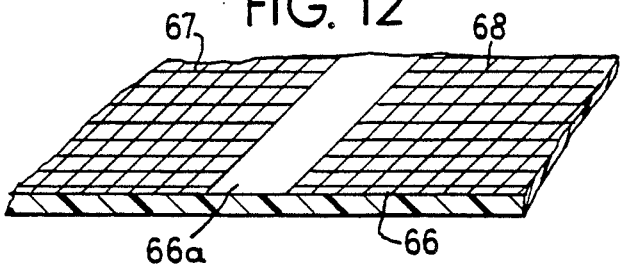

FIG. 12 illustrates a barrier membrane 66 wherein reinforcing scrim 67 and 68 is laminated to the membrane leaving a tear area **66*a* in between. When a separating force is applied to the membrane, it will tear at the location between the scrim laminations 67 and 68**.

Figure 13:
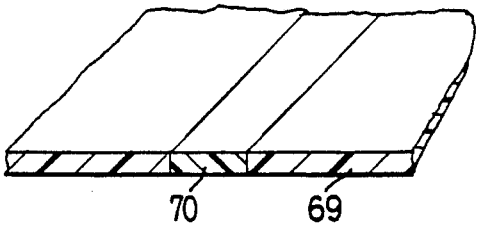

FIG. 13 illustrates a further structure wherein a barrier membrane 69 has an insert 70 of dissimilar polymer with the insert 70 extending in a narrow line parallel to the extent of the profiles.

Figure 14:
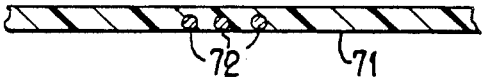

FIG. 14 illustrates another barrier membrane 71 wherein tear inserts are included in the membrane. These inserts will weaken the membrane such that a separation will occur along the line of the inserts.

Figure 15:
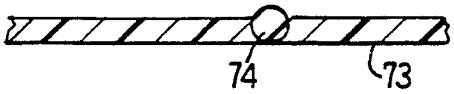

FIG. 15 illustrates a barrier membrane 73 wherein an annealed fracture point 74 extends along the membrane 73 so that it will tear along the line 74.

Figure 16:
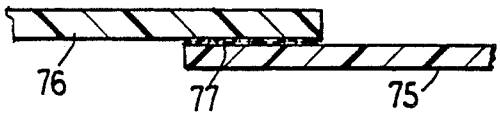

FIG. 16 illustrates an arrangement wherein the barrier membrane is formed in two parts 75 and 76 joined along a line of weakened bond. The barrier membrane will tear along this line of weakened bond but the line will provide a moisture barrier until such time when the bag is first opened.

Figure 17:
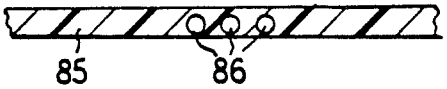

FIG. 17 illustrates a barrier membrane 85 which is extruded with voids 86 extending therealong. These voids will provide a line of separation when a tearing force is applied to the membrane.

Figure 18:
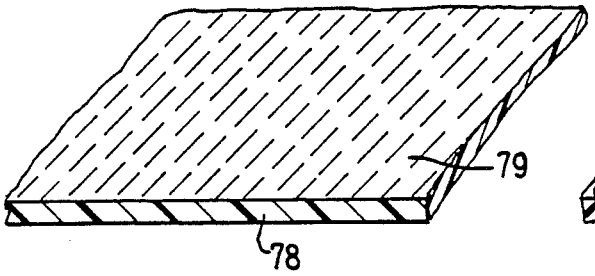

FIG. 18 illustrates a membrane 78 formed of a plastic which has a monograin orientation extending along the length thereof This grain orientation will insure that the membrane tears across the bag when a separating force is applied.

Figure 19:
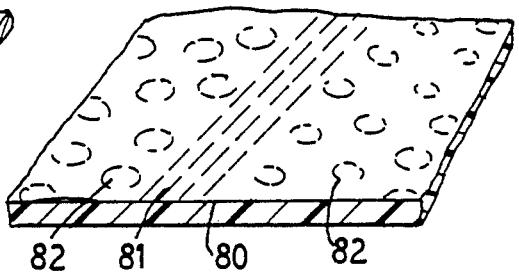

FIG. 19 illustrates a modification of the arrangement of FIG. 18 wherein a barrier membrane 80 is provided with grain orientation extending unidirectional along a line 81. At either side of the area of monograin orientation 81, the membrane has biaxial orientation at the sides 82 to insure that the membrane 80 will tear along the grain orientation line 81.

Figure 20:
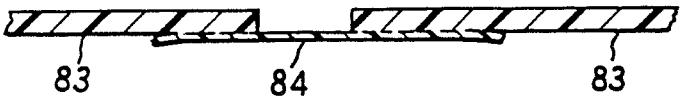

FIG. 20 illustrates a further arrangement wherein a barrier membrane is formed of two portions 83 having a weaker separation portion 84 extending therealong. This separator weak portion 84 will insure tearing along the line 84.

Thus, there has been provided a reclosable package, yet one which is completely sealed against contaminants. The structure is particularly well suited for use with foodstuffs and provides a seal, but with the convenience of a reusable reclosable package.

We claim as our invention:

1. A plastic bag for foodstuffs or the like, comprising in combination:

a first plastic film bag wall joined at its edge to a second plastic film bag wall with a bag mouth at a top of the bag between the walls at a top of the bag;

reclosable fastener strips between the walls at the bag mouth having facing releasably interlocking profiles thereon each with a base web bonded to the confronting surfaces of the film, each base web having an inner portion extending downwardly toward the bag interior and an outer portion extending outwardly above the profiles;

the inner portion of said base webs being joined to each other to seal the bag interior;

frangible tear means on the inner portion of one of said base webs for breaking into the bag interior so that the profiles can be separated and thereafter afford a reclosable bag mouth; and the inner portion of one of said base webs being bonded to the film and the inner portion of the other base web forming a barrier membrane and being substantially free of the attachment to the film.

2. A plastic film bag for foodstuffs or the like constructed in accordance with claim 1:

wherein said frangible tear means has stress concentration areas so that initiation of tearing of the frangible tear means will be possible.

3. A plastic bag for foodstuffs or the like, comprising in combination:

a first plastic film bag wall joined at its edge to a second plastic film bag wall with a bag mouth at a top of the bag between the walls at a top of the bag;

reclosable fastener strips between the walls at the bag mouth having facing releasably interlocking profiles thereon each with a base web bonded to the confronting surfaces of the film, each base web having an inner portion extending downwardly toward the bag interior and an outer portion extending outwardly above the profiles;

the inner portion of said base webs bearing joined to each other to seal the bag interior;

frangible tear means on the inner portion of one of said base webs for breaking into the bag interior so that the profiles can be separated and thereafter afford a reclosable bag mouth; and said frangible tear means being in the form of a perforation line through said one base web with the bond line following an undulating path to define points of stress concentration along tear means.

4. A plastic film bag for foodstuffs or the like ted in accordance with claim 1:

wherein the outer portions of the base webs are free of attachment to each other to provide pull flanges.

5. A plastic film bag for foodstuffs or the like constructed in accordance with claim 1:

wherein the film bag walls extend outwardly beyond the fastener strips and are bonded to each other so that access to the fastener strips can be made cutting off the bonded film area.

6. A plastic film bag for foodstuffs or the like constructed in accordance with claim 1:

wherein the outer portions of the base webs are free of attachment to each other and one outer portion is longer than the other.

7. A plastic film bag for foodstuffs or the like constructed in accordance with claim 6:

wherein said one longer outer portion is bonded between outer extensions of the film bag walls extending outwardly beyond the fastener strips.

8. The method of making a flexible plastic container for foodstuffs or the like comprising the steps:

forming opposed plastic film walls for defining a bag with a mouth at the bag top;

forming reclosable fastener strips with base webs and confronting pressure closable reopenable profiles thereon, the webs having an inner portion at one side of the profiles adjacent the bag interior and an outer portion at the other side of the profile extending toward the bag top, said inner portions jointed to each other;

surface bonding the base webs of the strips between the film walls;

forming a frangible tear line between the inner portions of the base webs;

and joining one inner portion of one base web to the bag wall and leaving the inner portion of the other base web substantially free of attachment to the film wall except at the distal edge thereof.

9. The method of making a flexible plastic container for foodstuffs or the like in accordance with the steps of claim 8:

including forming perforations through the joined inner portions of the webs to provide said tear line.

10. The method of making a flexible plastic container for foodstuffs or the like in accordance with the steps of claim 9:

wherein said perforations are formed in one inner portion of the web.

11. The method of making a flexible plastic container for foodstuffs or the like in accordance with the steps of claim 9:

wherein said perforations are formed at a folded edge between said inner portions of the base webs.

12. The method of making a flexible plastic container for foodstuffs or the like in accordance with the steps of claim 9;

wherein a sealing strip is placed over the perforations.

13. The method of making a flexible plastic container for foodstuffs or the like in accordance with the steps of claim 9:

wherein a bond line is formed in a base web in an undulating pattern to provide stress concentration locations for tearing the perforation.

14. A plastic film bag for foodstuffs or the like, comprising in combination:

a first plastic film bag wall joined at its edge to a second plastic film bag wall with a bag mouth formed between the walls at the bag top;

and reclosable fastener strips between the walls at the bag mouth having facing releasably interlocking profiles thereon each with a base web having a portion extending inwardly toward the interior of the bag, one of said base web portions laminated to the bag wall film and the other of said base web portions being bonded at its distal edge to the bag wall with the remainder of said other web portion being free of attachment intermediate its edges to form a free barrier membrane separating the bag interior from the profiles.

15. A plastic film bag for foodstuffs or the like, comprising in combination:

opposed plastic film bag wall panels joined at their edges to provide a bag with a mouth at the bag top;

reclosable fastener strips between the walls at the bag mouth having facing releasably interlocking profiles thereon each with a base web having portions extending inwardly toward the bag interior;

one of said inwardly extending base web portions laminated to the film wall with the other inwardly extending base web portion free of lamination and forming a membrane between the profiles and bag interior and with a distal edge attached to an opposing bag wall panel;

and a semi-rigid board folded over the edge of the contents positioned against the unattached base web portion so said other base web portion provides a barrier membrane between the bag contents and the profiles.

16. A plastic film bag for foodstuffs or the like, comprising the combination:

a first plastic film bag wall joined at its edges to a second plastic film bag wall with a bag mouth between the wall at the top of the bag;

reclosable fastener strips between the walls at the bag mouth having facing releasably interlocking profiles thereon; and a barrier membrane inwardly of the profiles separating the profiles from the interior of the bag and being attached to the first wall adjacent the profiles and attached to the second wall at a location spaced from the profiles so that contents of the bag lie between the membrane and first wall and so that the membrane can easily be severed adjacent the second wall.

17. A plastic film bag for foodstuffs or the like constructed in accordance with claim 16:

including a frangible fracture line extending along the membrane substantially parallel to the profiles and a pull force can be applied by separating the profiles pulling on the membrane between the location of attachment adjacent the profile on the first wall and the location of attachment to the second wall spaced from the profiles for breaking the membrane when the profiles are first separated.

* * * * *